United States Patent [19]

Pennington

[11] 4,181,358

[45] Jan. 1, 1980

[54] PATIENT RESTRAINT FOR USE ON A CHAIR OR THE LIKE

[76] Inventor: Ramona K. Pennington, 358 N. 41st St., Omaha, Nebr. 68131

[21] Appl. No.: 882,343

[22] Filed: Mar. 1, 1978

[51] Int. Cl.[2] ..... A47C 27/00; A47C 31/00

[52] U.S. Cl. ..... 297/467; 128/134; 297/148; 297/219

[58] Field of Search ..... 297/148, 384, 385, 390, 297/216, 5, 135, 219; 128/134, 133; 5/332 R, 332 B

[56] References Cited

U.S. PATENT DOCUMENTS

| | | | |
|---|---|---|---|
| 1,172,103 | 2/1916 | Bennett | 297/103 |
| 1,205,384 | 11/1916 | Peck | 297/219 |
| 1,376,625 | 5/1921 | Johnston | 297/219 |
| 1,391,249 | 9/1921 | Finney | 297/390 X |
| 1,404,572 | 1/1922 | Bowman | 297/148 X |
| 1,538,538 | 5/1925 | Wood | 297/390 X |
| 2,362,465 | 11/1944 | Carner | 297/148 |
| 2,451,007 | 10/1948 | White | 297/219 |
| 2,467,252 | 4/1949 | Brandon | 297/385 |
| 2,544,760 | 3/1951 | Johnson | 297/390 X |
| 2,652,883 | 9/1953 | Holtzendorf | 297/390 X |
| 3,335,434 | 8/1967 | Gamon | 5/332 R |
| 3,669,107 | 6/1972 | Posey | 128/134 |
| 3,713,692 | 1/1973 | McCraken | 297/390 X |

*Primary Examiner*—James T. McCall

*Attorney, Agent, or Firm*—Zarley, McKee, Thomte, Voorhees & Sease

[57] ABSTRACT

A patient restraint for use on a chair or the like is described and comprises an elongated support member which is adjustably secured to the rearward pair of legs of the chair. A flexible sheet member is secured at its rearward end to the support member and extends upwardly therefrom over the seat portion of the chair. The forward end of the flexible sheet member is provided with a forward end portion which is adapted to be positioned between the patient's legs and extended upwardly therefrom. An elongated flexible strap is secured to the forward end portion and extends upwardly therefrom, through a bracket on the tray, then downwardly over the forward portion of the seat, then rearwardly for connection with the support member.

8 Claims, 6 Drawing Figures

PATIENT RESTRAINT FOR USE ON A CHAIR OR THE LIKE

BACKGROUND OF THE INVENTION

This invention relates to a restraining device which is ideally suited for use with a chair or the like.

Geriatric patients frequently do not have the strength to support themselves in a sitting position in a wheelchair, hospital chair, etc. Some types of hospital chairs employ a tray which extends between the side arms of the chair. One method of attempting to prevent the patient from sliding downwardly in the chair is to slide the tray into abutting engagement with the patient's chest or stomach. This frequently does not work and the patients tend to slide downwardly in the chair and can strangle themselves or otherwise seriously injure themselves.

Another method used to restrain the elderly patients in their chairs is to tie a towel or the like around the patient and the chair. However, such a method is uncomfortable and unduly restrains the patient.

Therefore, it is a principal object of the invention to provide an improved restraining device for use with a chair or the like.

A further object of the invention is to provide a restraining device for use on a chair wherein the restraining device is adjustably secured thereto to compensate for different patient sizes.

A still further object of the invention is to provide a restraining device for use with a chair or the like which prevents the patient from sliding downwardly in the chair.

A still further object of the invention is to provide a restraining device for use with a chair or the like which is comfortable.

A still further object of the invention is to provide a restraining device for use with a chair or the like which prevents the patient from leaving the chair.

A still further object of the invention is to provide a restraining device which is economical of manufacture, durable in use and refined in appearance.

These and other objects will be apparent to those skilled in the art.

SUMMARY OF THE INVENTION

Figure 1:
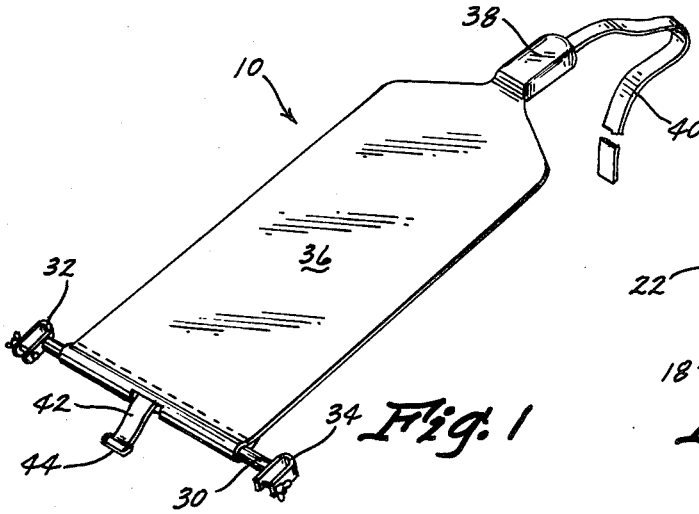
FIG. 1 is a perspective view of the restraining device.
Figure 2:
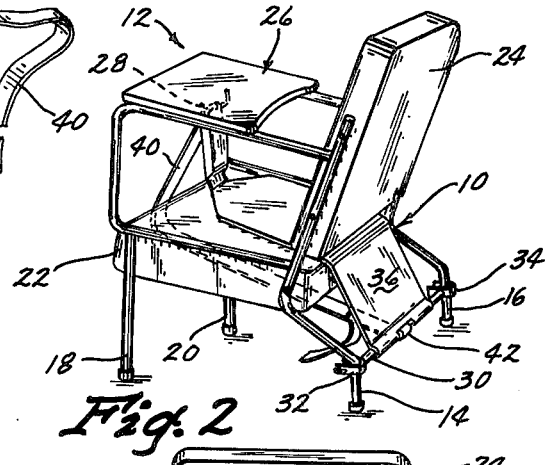
FIG. 2 is a perspective view of the device mounted on a chair.
Figure 3:
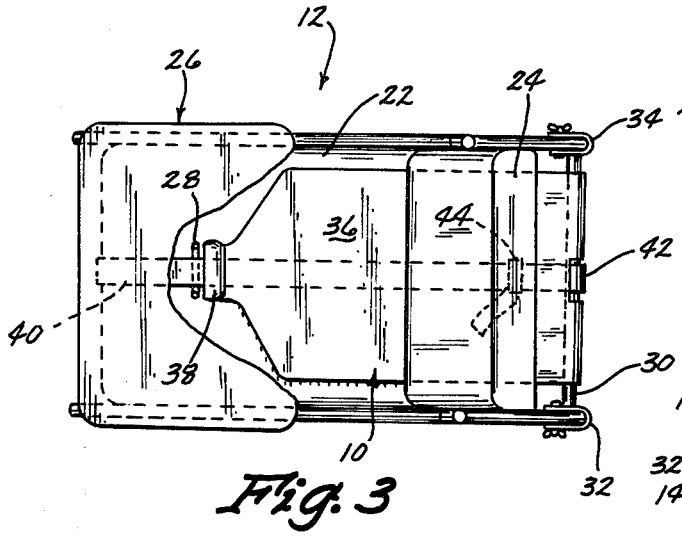
FIG. 3 is a top view of a chair having the restraining device mounted therein.
Figure 4:
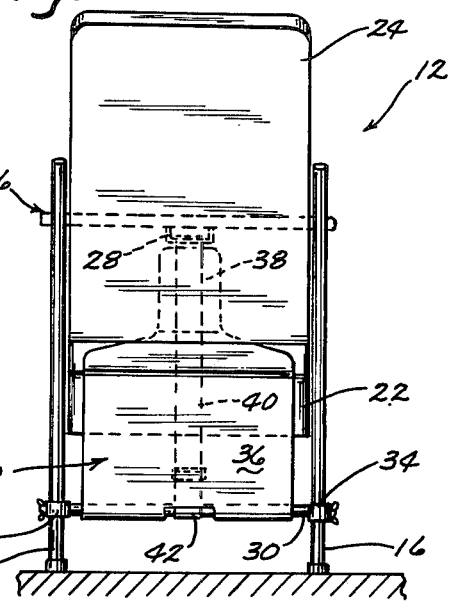
FIG. 4 is a rear view of the device mounted on a chair.
Figure 5:
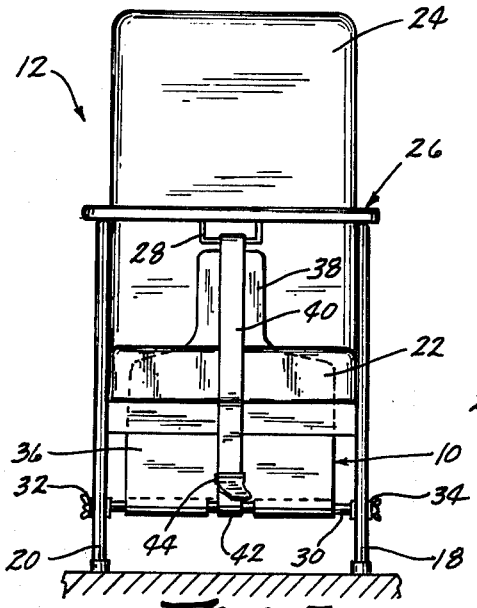
FIG. 5 is a front view of the device mounted on a chair.
Figure 6:
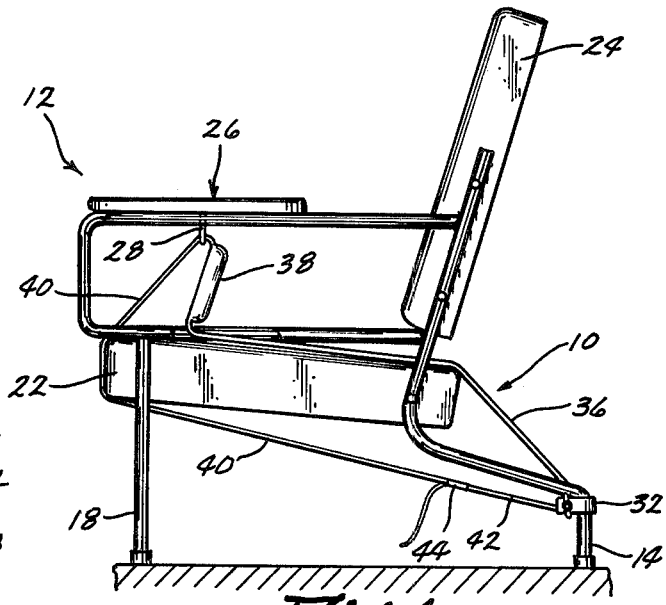
FIG. 6 is a side view of the device mounted on a chair.

The restraining device of this invention may be used with a conventional hospital chair or with a wheelchair. An elongated supporting member is secured to the rearward legs of the chair and may be adjustably moved vertically to compensate for different patient sizes. A flexible sheet member is secured to the support member and extends upwardly therefrom over the seat portion of the chair. A padded portion is provided at the forward end of the flexible sheet member and extends upwardly therefrom between the patient's legs. An elongated flexible strap is secured to the upper end of the forward end portion and extends through a bracket on the tray secured to the chair, thence downwardly over the forward end of the seat portion, thence beneath the seat portion for connection to the support member.

DESCRIPTION OF THE PREFERRED EMBODIMENT

The restraining device of this invention is referred to generally by the reference numeral 10 while the reference numeral 12 refers to a conventional hospital chair generally comprising a pair of rear legs 14 and 16, front legs 18 and 20, seat portion 22 and back portion 24. The numeral 26 refers generally to a tray means which is adjustably mounted on the chair in conventional fashion. Tray means 26 is provided with a bracket 28 which extends downwardly from the underside thereof.

Restraining device 10 generally comprises an elongated support member 30 in the form of a tube or the like having a pair of U-shaped clamps 32 and 34 at the opposite ends thereof. A flexible sheet member 36 is secured at its rearward end to the support member 30 and extends therefrom and terminates in a padded forward end portion 38 which has a width substantially less than the remainder of the sheet member. An elongated flexible strap 40 is secured to the forward end portion as stitching or the like. A flexible strap 42 is secured to the center of support member 30 and has a double-ring connector 44 thereon.

The device is secured to the chair as follows. The U-shaped clamps 32 and 34 are secured to the rear legs 14 and 16 with the threaded members thereof being tightened to positively maintain the support member 30 in position. The support member 30 may be selectively vertically adjusted with respect to the rear legs 14 and 16 to adjust the position of the forward end portion 38 as will be described in more detail hereinafter.

Sheet member 36 extends upwardly from support member 30, between seat portion 22 and back portion 24 and over seat portion 22. The forward end portion 38 would simply rest on the seat portion 22 until it is desired to place the patient therein.

When it is desired to place the patient therein, the tray 26 is removed from the chair to permit the patient to sit on the chair. After the patient has been positioned on the chair, the tray is replaced on the supporting arms. Forward end portion 38 is then extended upwardly between the patient's legs and the strap 40 is extended through the bracket 28. Strap 40 is then extended downwardly from bracket 28 over the forward end of the seat portion 22, thence downwardly and rearwardly beneath seat portion 22. Strap 40 is then secured to the double-ring connector 44 in conventional fashion so that forward end portion 38 will be positioned in the vertical position illustrated in the drawings.

The forward end portion 38 prevents the patient from sliding forwardly from the chair since the forward end portion 38 will engage the crotch area of the patient and limit the forward sliding movement thereof. By vertically adjusting the support member 30 with respect to the rear legs of the chair, the position of the forward end portion 38 may be moved forwardly or rearwardly to compensate for different patient sizes.

It has been found that the restraining device not only prevents the patient from sliding forwardly from the chair but it also helps to prevent the patient from climbing upwardly from the chair since the width of the forward end portion 38 hinders the patient pulling his legs upwardly from beneath the tray.

While it has been described that the device is ideally suited for a hospital chair such as disclosed in the drawings, the device works equally well with other types of chairs such as wheelchairs, etc., as long as they have some means of attaching the support member 30 thereto.

The restraining device of this invention restrains the patient in the chair in a comfortable and safe manner and thus accomplishes at least all of its stated objectives.

I claim:

1. In combination, a chair means having at least a pair of supporting leg members at its rearward end, a back portion, a seat portion and a tray means positioned above the seat portion, a support means secured to the pair of supporting leg members and extending therebetween, a flexible sheet member secured at its rearward end to said support means and extending upwardly therefrom forwardly over the said seat portion, said sheet member having a forward end portion adapted to be positioned between a person's legs and extended upwardly therebetween, an elongated flexible strap means secured to said forward end portion and extending upwardly therefrom for connection with the tray means, thence downwardly beneath said seat portion and being connected to said support means.

2. The combination of claim 1 wherein said support means is vertically adjustably secured to said supporting leg members.

3. The combination of claim 1 wherein a flexible strap member is secured to said support means at the center thereof, a connector means on said flexible strap member, said flexible strap means being removably secured to said connector means.

4. The combination of claim 3 wherein said flexible strap means is length adjustably secured to said connector means.

5. The combination of claim 1 wherein said support means comprises an elongated pipe having U-shaped clamps at its opposite ends, said U-shaped clamps being adjustably secured to said supporting leg members.

6. The combination of claim 1 wherein said tray means has a bracket secured to the underside thereof, said flexible strap means extending through said bracket.

7. The combination of claim 1 wherein said forward end portion has a width substantially less than said flexible sheet member.

8. The combination of claim 7 wherein said forward end portion is padded.

* * * * *